US007974429B2

(12) United States Patent
Tsai

(10) Patent No.: US 7,974,429 B2
(45) Date of Patent: Jul. 5, 2011

(54) WIRELESS MICROPHONE

(75) Inventor: Yi-Nan Tsai, Chiayi (TW)

(73) Assignee: MIPRO Electronics Co., Ltd., Chiayi (TW)

( * ) Notice: Subject to any disclaimer, the term of this patent is extended or adjusted under 35 U.S.C. 154(b) by 1171 days.

(21) Appl. No.: 11/709,045

(22) Filed: Feb. 20, 2007

(65) Prior Publication Data

US 2007/0212599 A1 Sep. 13, 2007

(30) Foreign Application Priority Data

Mar. 13, 2006 (TW) ..... 95204111 U

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/361; 381/355; 381/360

(58) Field of Classification Search ..... 381/355, 381/359, 360, 361, 362, 363, 366, 323; 429/97, 429/98, 100; 455/95

See application file for complete search history.

(56) References Cited

U.S. PATENT DOCUMENTS

| | | | | |
|---|---|---|---|---|
| 4,910,795 | A * | 3/1990 | McCowen et al. | 455/95 |
| 6,778,814 | B2 * | 8/2004 | Koike | 455/95 |
| 6,968,070 | B1 * | 11/2005 | Chiang | 381/361 |
| 2001/0034214 | A1 * | 10/2001 | Koike | 455/95 |
| 2007/0223764 | A1 * | 9/2007 | Chang | 381/361 |

* cited by examiner

*Primary Examiner* — Tuan D Nguyen

(74) *Attorney, Agent, or Firm* — Quine Intellectual Property Law Group, P.C.

(57) ABSTRACT

A wireless microphone includes a tubular housing having top and bottom open ends. The housing has an outer surrounding wall and an inner partition wall. The inner partition wall cooperates with an upper portion of the outer surrounding wall so as to define a battery-receiving space. A battery module is received in the battery-receiving space. A head unit is mounted on the top open end of the housing, and covers the battery module. A positioning unit is disposed at an outer surrounding surface of the battery module and an inner surrounding surface of the outer surrounding wall of the housing for positioning the battery module in the battery-receiving space.

6 Claims, 5 Drawing Sheets

WIRELESS MICROPHONE

CROSS-REFERENCE TO RELATED APPLICATION

This application claims priority of Taiwanese Application No. 095204111, filed on Mar. 13, 2006.

BACKGROUND OF THE INVENTION

1. Field of the Invention

The invention relates to a microphone, more particularly to a wireless microphone.

2. Description of the Related Art

Referring to FIG. 1, a conventional wireless microphone is shown to include a tubular housing 12 configured with a battery-receiving space 10, a battery 11 received in the battery-receiving space 10 in the housing 12, and a head cover 13 mounted on an open end of the housing 12 for covering the battery 11. The housing 12 is provided with a first conductive contact 14 that disposed in the battery-receiving space 10. The head cover 13 is provided with a second conductive contact 15. The battery 11 has opposite power electrodes 111, 112 that contact electrically and respectively the second and first conductive contacts 15, 14.

In such a configuration, the battery 11 is merely received in a battery-receiving space 10, and cannot be effectively positioned such that the battery 11 may wobble within the battery-receiving space 10 whenever the conventional wireless microphone is waved, thereby resulting in signal interruption during use.

SUMMARY OF THE INVENTION

Therefore, the object of the present invention is to provide a wireless microphone that includes a positioning unit capable of firmly positioning a battery module in a housing.

According to the present invention, a wireless microphone comprises:

a tubular housing extending in a longitudinal direction and having top and bottom open ends opposite to each other in the longitudinal direction, the housing having an annular outer surrounding wall, and an inner partition wall transverse to the longitudinal direction and having a periphery connected fixedly to an inner surrounding surface of the outer surrounding wall, the inner partition wall cooperating with an upper portion of the outer surrounding wall disposed adjacent to the top open end of the housing so as to define a battery-receiving space;

a columnar battery module received in the battery-receiving space in the housing and having an outer surrounding surface;

a head unit mounted on the top open end of the housing and covering the battery module; and a positioning unit disposed at the outer surrounding surface of the battery module and the inner surrounding surface of the outer surrounding wall of the housing for positioning the battery module in the battery-receiving space in the housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
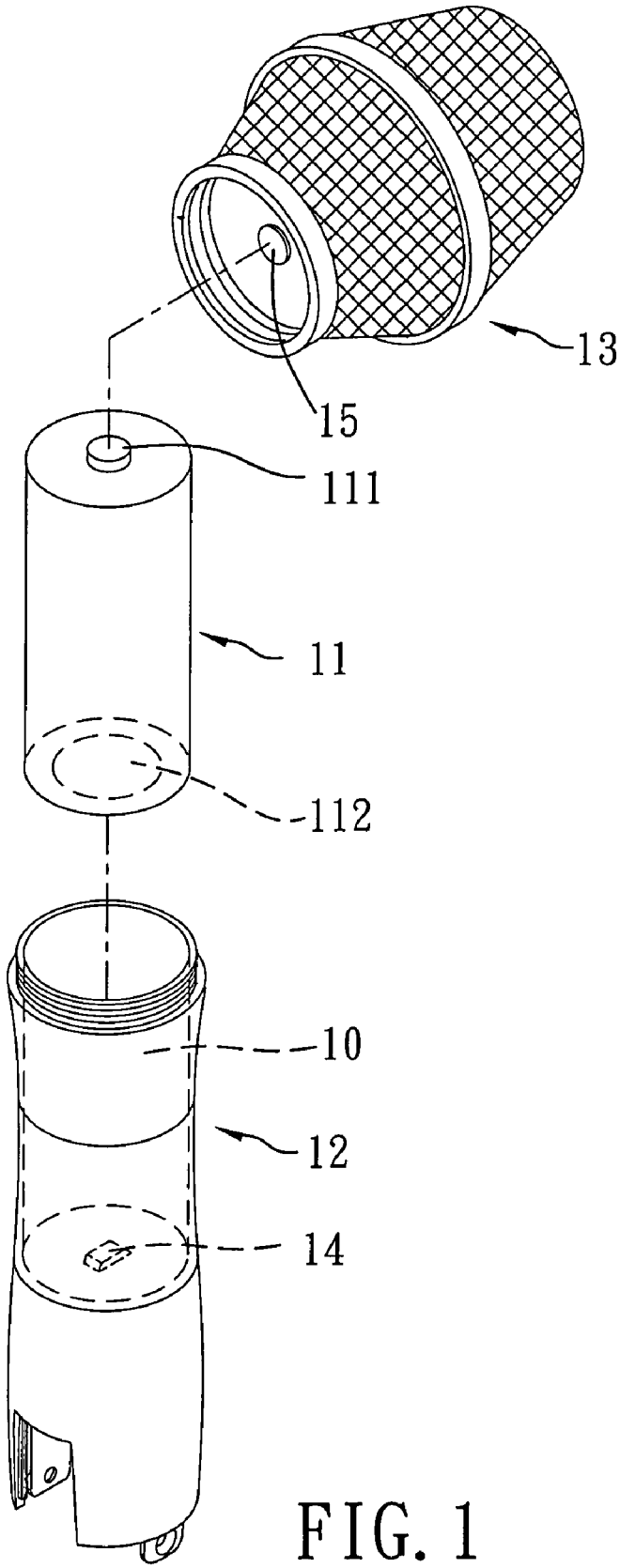
FIG. 1 PRIOR ART
FIG. 1 is an exploded perspective view of a conventional wireless microphone.

Before the present invention is described in greater detail, it should be noted that like elements are denoted by the same reference numerals throughout the disclosure.

Figure 2:
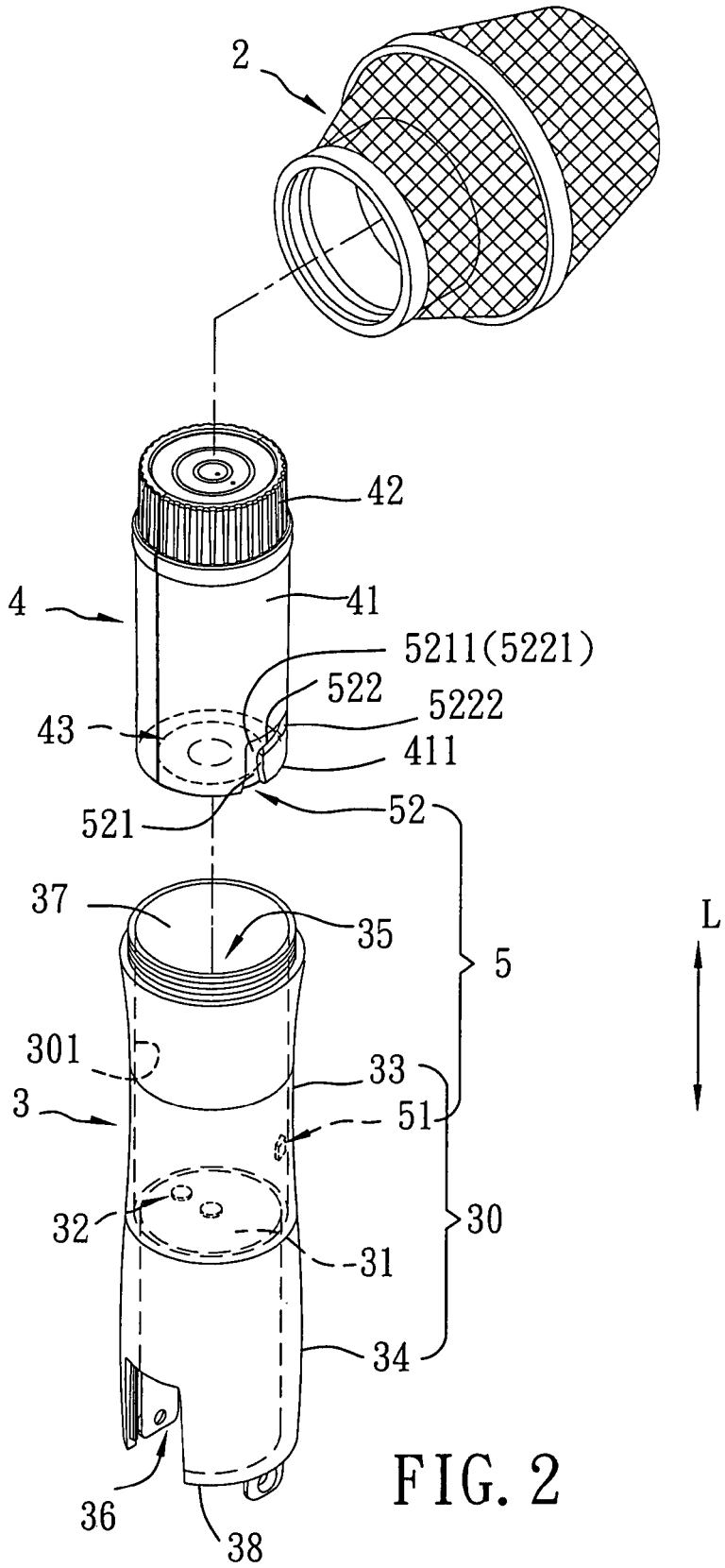
FIG. 2 is an exploded perspective view showing the first preferred embodiment of a wireless microphone according to the present invention.
Figure 3:
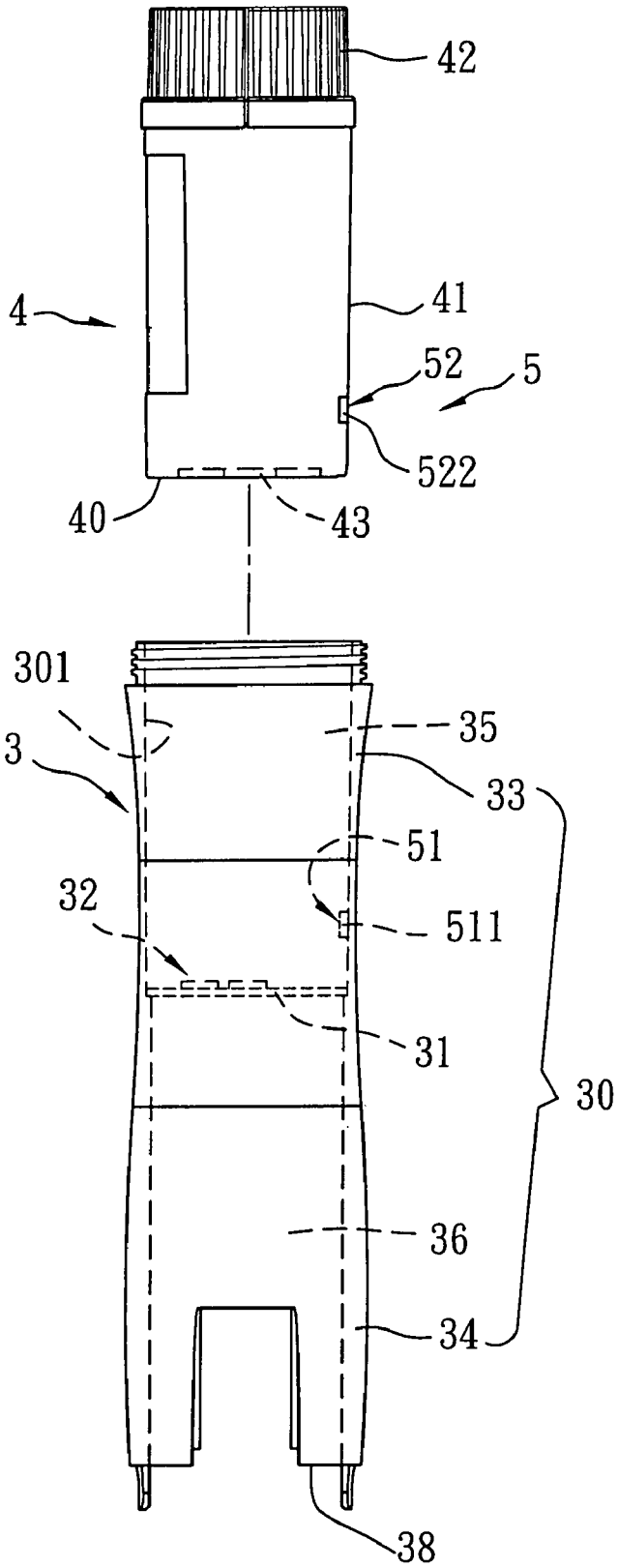
FIG. 3 is an exploded schematic side view of the preferred embodiment, illustrating how a battery module is assembled to a tubular housing.
Figure 4:
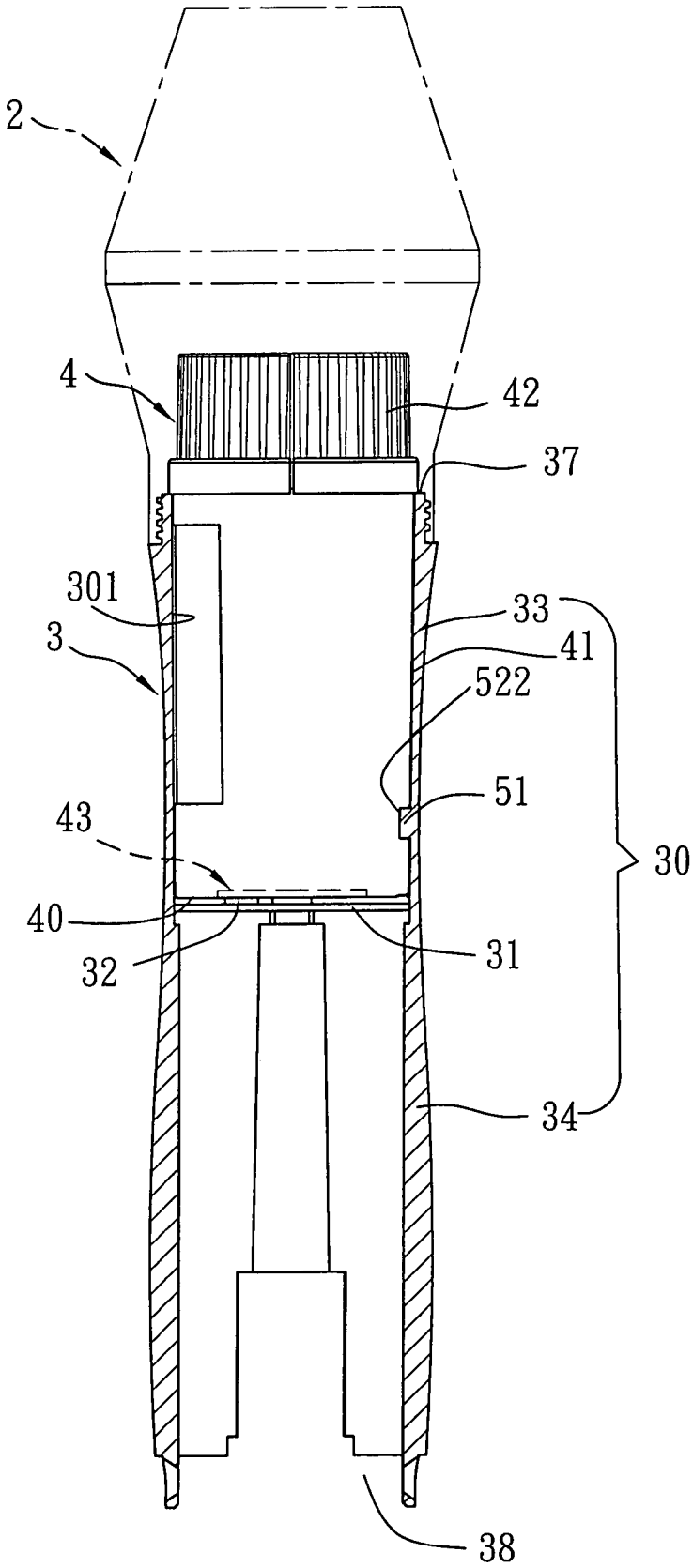
FIG. 4 is a schematic sectional view of the preferred embodiment, illustrating an assembly of the battery module and the housing.

Referring to FIGS. 2 to 4, the first preferred embodiment of a wireless microphone according to the present invention is shown to include a tubular housing 3, a battery module 4, a head unit 2, and a positioning unit 5.

The tubular housing 3 extends in a longitudinal direction (L), and has top and bottom open ends 37, 38 opposite to each other in the longitudinal direction (L). The housing 3 has an annular outer surrounding wall 30, and an inner partition wall 31 transverse to the longitudinal direction (L) and having a periphery connected fixedly to an inner surrounding surface 301 of the outer surrounding wall 30. The outer surrounding wall 30 is divided by the inner partition wall 31 into an upper portion 33 disposed adjacent to the top open end 37 of the housing 3, and a lower portion 34 disposed adjacent to the bottom open end 38 of the housing 3. As such, the inner partition wall 31 cooperates with the upper portion 33 of the outer surrounding wall 30 so as to define a battery-receiving space 35, while the inner partition wall 31 cooperates with the lower portion 34 of the outer surrounding wall 30 so as to define a circuit-receiving space 36 for receiving a circuit module (not shown). Since the circuit module is irrelevant to the claimed invention, a detailed description of the same is omitted herein for the sake of brevity. In this embodiment, the inner partition wall 31 of the housing 3 is provided with a set of conductive contacts 32 that are connected electrically to the circuit module and that are disposed in the battery-receiving space 35 in the housing 3.

The battery module 4 is received in the battery-receiving space 35 in the housing 3, and has an outer surrounding surface 41. In this embodiment, the battery module 4 has an upper operating end portion 42 extending from the top open end 37 of the housing 3 (see FIG. 4), and a bottom surface 40 provided with a set of power electrodes 43 that contact electrically and respectively the conductive contacts 43 for supplying electric power to the circuit module.

The head unit 2 is mounted on the top open end 37 of the housing 3 for receiving audio signals in a known manner, and covers the upper operating end portion 42 of the battery module 4 (see FIG. 4).

The positioning unit 5 is disposed at the outer surface 41 of the battery module 4 and the inner surrounding surface 301 of the outer surrounding wall 30 of the housing 3 for positioning the battery module 4 in the battery-receiving space 35 in the housing 3.

In this embodiment, the positioning unit 5 includes an engaging block 51 formed on the inner surrounding surface 301 of the outer surrounding wall 30 of the housing 3 and disposed in the battery-receiving space 35 in the housing 3, and an inverted L-shaped engaging groove 52 formed in the outer surrounding surface 41 of the battery module 4. The engaging groove 52 has a first groove portion 521 that extends upwardly in the longitudinal direction (L) from a bottom end 411 of the outer surrounding surface 41 of the battery module 4, and a horizontally extending second groove portion 522 that has a first end 5221 connected spatially to an upper end 5211 of the first groove portion 521, and a second end 5222 opposite to the first end 5221. The engaging block 51 is press-fitted in the second end 5222 of the second groove portion 522 of the engaging groove 52.

When the battery module 4 is assembled to the housing 3, the engaging block 51 of the positioning unit 5 is guided by the first groove portion 521 of the engaging groove 52 into the first end 5221 of the second groove portion 522 of the engaging groove 52 in the positioning unit 5, after which the battery module 4 is rotated in a direction by operating the upper operating end portion 42 so as to move the engaging block 51 into the second end 5222 of the second groove portion 522 of the engaging groove 52, thereby positioning the battery module 4 in the battery-receiving space 35 in the housing 3.

Figure 5:
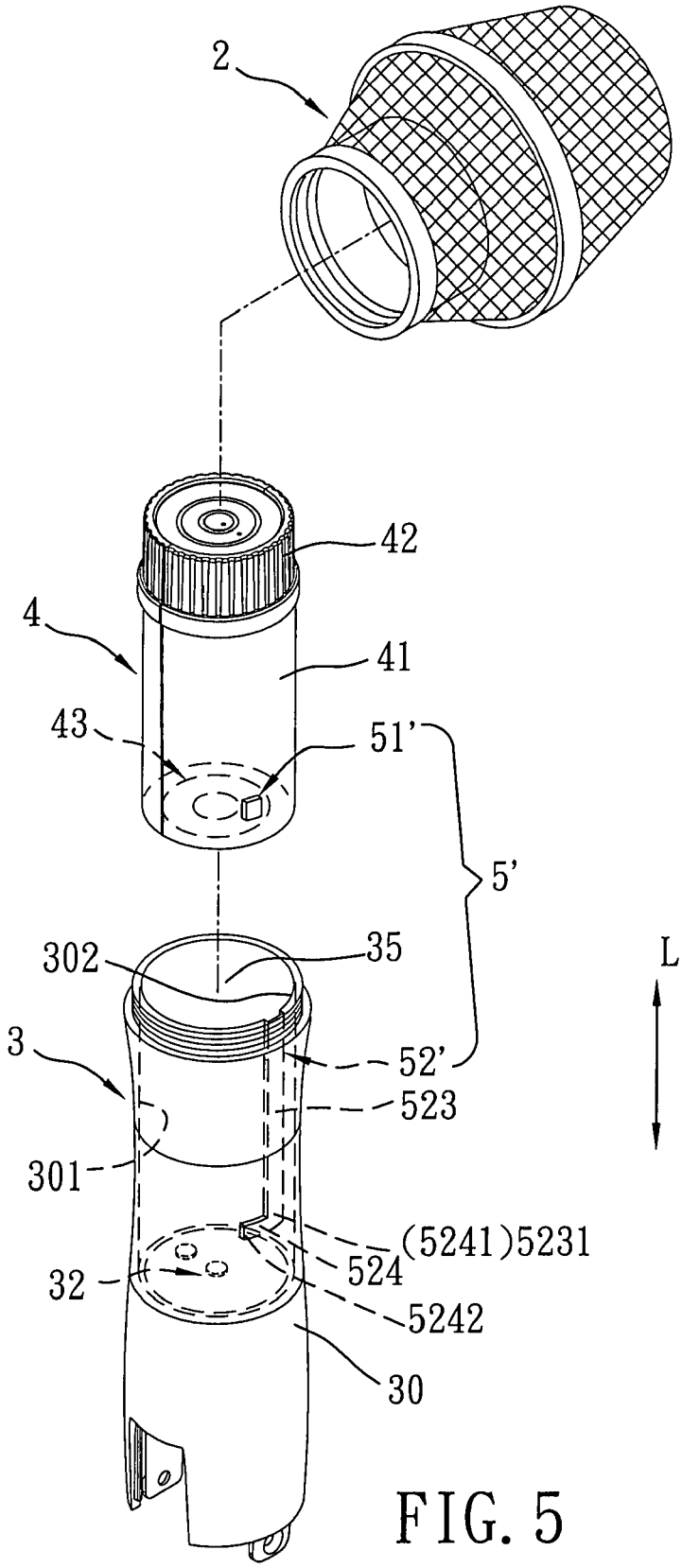
FIG. 5 is an exploded perspective view showing the second preferred embodiment of a wireless microphone according to the present invention.

FIG. 5 illustrates the second preferred embodiment of a wireless microphone according to this invention, which is a modification of the first preferred embodiment. In this embodiment, the positioning unit 5' includes an engaging block 51' formed on the outer surrounding surface 41 of the battery module 4, and an L-shaped engaging groove 52' formed in the inner surrounding surface 301 of the outer surrounding wall 30 of the housing 3. The engaging groove 52' has a first groove portion 523 that extends downwardly in the longitudinal direction (L) from a top end 302 of the inner surrounding surface 301 of the outer surrounding wall 30 of the housing 3, and a horizontally extending second groove portion 524 that has a first end 5241 connected spatially to a lower end 5231 of the first groove portion 523, and a second end 5242 opposite to the first end 5241. The engaging block 51' is press-fitted in the second end 5242 of the second groove portion 524 of the engaging groove 52'.

When the battery module 4 is assembled to the housing 3, the engaging block 51' of the positioning unit 5' is guided by the first groove portion 523 of the engaging groove 52' of the positioning unit 5' into the first end 5241 of the second groove portion 524 of the engaging groove 52', after which the battery module 4 is rotated in a direction by operating the upper opening end portion 42 so as to move the engaging block 51' into the second end 5242 of the second groove 524, thereby positioning the battery module 4 in the battery-receiving space 35 in the housing 3.

To sum up, due to the presence of the positioning unit 5, 5', the battery module 4 can be firmly positioned in the battery-receiving space 35 in the housing 3 such that electrical contact between the power electrodes 43 of the battery module 4 and the conductive contacts 32 on the inner partition wall 31 can be ensured. As a result, stable power supply from the battery module 4 can be achieved, thereby avoiding undesired signal interruption whenever the wireless microphone of this invention is waved.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A wireless microphone comprising:

a tubular housing extending in a longitudinal direction and having top and bottom open ends opposite to each other in the longitudinal direction, said housing having an annular outer surrounding wall, and an inner partition wall transverse to the longitudinal direction and having a periphery connected fixedly to an inner surrounding surface of said outer surrounding wall, said inner partition wall cooperating with an upper portion of said outer surrounding wall disposed adjacent to said top open end of said housing so as to define a battery-receiving space;

a columnar battery module received in said battery-receiving space in said housing and having an outer surrounding surface;

a head unit mounted on said top open end of said housing and covering said battery module; and a positioning unit disposed at said outer surrounding surface of said battery module and said inner surrounding surface of said outer surrounding wall of said housing for positioning said battery module in said battery-receiving space in said housing.

2. The wireless microphone as claimed in claim 1, wherein said positioning unit includes:

an engaging block formed on said inner surrounding surface of said outer surrounding wall of said housing and disposed in said battery-receiving space in said housing; and an inverted L-shaped engaging groove formed in said outer surrounding surface of said battery module, said engaging groove having a first groove portion that extends upwardly in the longitudinal direction from a bottom end of said outer surrounding surface of said battery module, and a horizontally extending second groove portion that has a first end connected spatially to an upper end of said first groove portion, and a second end opposite to said first end, said engaging block being disposed in said second end of said second groove portion of said engaging groove;

whereby, when said battery module is assembled to said housing, said engaging block is guided by said first groove portion of said engaging groove into said first end of said second groove portion of said engaging groove, after which said battery module is rotated in a direction so as to move said engaging block into said second end of said second groove portion, thereby positioning said battery module in said battery-receiving space in said housing.

3. The wireless microphone as claimed in claim 2, wherein:

said battery module has a bottom surface provided with a set of power electrodes; and said inner partition wall of said housing is provided with a set of conductive contacts that contact electrically and respectively said power electrodes of said battery module when said battery module is positioned in said battery-receiving space in said housing and when said engaging block is disposed at said second end of said second groove portion of said engaging groove.

4. The wireless microphone as claimed in claim 1, wherein said positioning unit includes:

an engaging block formed on said outer surrounding surface of said battery module; and an L-shaped engaging groove formed in said inner surrounding surface of said outer surrounding wall of said housing, said engaging groove having a first groove portion that extends downwardly in the longitudinal direction from a top end of said inner surrounding surface of said outer surrounding wall of said housing, and a horizontally extending second groove portion that has a first end connected spatially to a lower end of said first groove portion, and a second end opposite to said first end, said engaging block being disposed in said second end of said second groove portion of said engaging groove;

whereby, when said battery module is assembled to said housing, said engaging block is guided by said first groove portion of said engaging groove into said first end of said second groove portion of said engaging groove, after which said battery module is rotated in a direction so as to move said engaging block into said second end of said second groove portion, thereby positioning said battery module in said battery-receiving space in said housing.

5. The wireless microphone as claimed in claim 4, wherein:

said battery module has a bottom surface provided with a set of power electrodes; and said inner partition wall of said housing is provided with a set of conductive contacts that contact electrically and respectively said power electrodes of said battery module when said battery module is positioned in said battery-receiving space in said housing and when said engaging block is disposed at said second end of said second groove portion of said engaging groove.

6. The wireless microphone as claimed in claim 1, wherein said battery module has an upper operating end portion extending from said top open end of said housing and covered by said head unit.

* * * * *